US011492996B2

(12) United States Patent
Laqua et al.

(10) Patent No.: US 11,492,996 B2
(45) Date of Patent: Nov. 8, 2022

(54) PISTON HAVING OUTER THREAD

(71) Applicant: KS Kolbenschmidt GmbH, Neckarsulm (DE)

(72) Inventors: Matthias Laqua, Bad Wimpfen (DE); Alexander Schäfer, Elztal (DE); Wolfgang Köhler, Bad Wimpfen (DE); Dieter Krämer, Heilbronn (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 0 days.

(21) Appl. No.: 16/802,603

(22) Filed: Feb. 27, 2020

(65) Prior Publication Data

US 2020/0191089 A1 Jun. 18, 2020

Related U.S. Application Data

(63) Continuation of application No. 15/765,774, filed as application No. PCT/EP2016/074033 on Oct. 7, 2016, now abandoned.

(30) Foreign Application Priority Data

Oct. 8, 2015 (DE) ..... 102015219 452.3
Dec. 18, 2015 (DE) ..... 102015225 952.8

(51) Int. Cl.
*F02F 3/00* (2006.01)

(52) U.S. Cl.
CPC ..... *F02F 3/0023* (2013.01)

(58) Field of Classification Search
CPC ..... F02F 3/0023; F02F 3/02
See application file for complete search history.

(56) References Cited

U.S. PATENT DOCUMENTS 1,492,294 A * 4/1924 Hanish ..... F02F 3/0023 92/160
2,159,989 A * 5/1939 Hazen ..... F02F 3/22 92/186
3,465,651 A * 9/1969 Tromel ..... F02F 3/22 92/186
5,363,822 A * 11/1994 Tuohy ..... F02F 3/0023 123/193.6
6,763,758 B2 * 7/2004 Kemnitz ..... F02F 3/22 92/186
2018/0355818 A1 * 12/2018 Laqua ..... F02F 3/22

FOREIGN PATENT DOCUMENTS

DE 106677 * 6/1974
DE 3249290 T5 1/1984
JP S60185046 U 12/1985

* cited by examiner

*Primary Examiner* — Michael Leslie
(74) *Attorney, Agent, or Firm* — Young Basile Hanlon & MacFarlane, P.C.

(57) ABSTRACT

The invention relates to a piston for an internal combustion engine formed from a lower part and an upper part which are threadingly connected to one another to form a piston. In one example, an anti-rotation safeguard device is used to prevent unwanted rotation of the upper part relative to the lower part. In another example, a forged extension and a nut are used to obtain a prestress during operation of the piston. In another example, a cooling gallery including extension bores are used to increase the cooling capacity.

13 Claims, 3 Drawing Sheets

PISTON HAVING OUTER THREAD

CROSS-REFERENCE TO RELATED APPLICATION(S)

This continuation application claims priority benefit to U.S. utility application Ser. No. 15/765,774 filed Aug. 23, 2018 the entire contents of which are incorporated herein by reference. U.S. utility application Ser. No. 15/765,774 is a 35 USC § 371 application claiming priority benefit to PCT/EP2016/074033 filed Oct. 7, 2016 which claims priority benefit to German patent application serial number 10 2015 225 952.8 filed Dec. 18, 2015 and German patent application serial number 10 2015 219 452.3 filed Oct. 8, 2015, the entire contents of which are incorporated herein by reference.

TECHNICAL FIELD

The invention relates to a piston of an internal combustion engine.

BACKGROUND

Pistons, in particular large bore pistons, which have an upper part and a lower part and which are connected to one another by means of a screw connection are known. In the case of said known large bore pistons, there is a flat contact between the upper part and the lower part, on which contact the upper part is supported on the lower part when the screw connection (for example, configured as an anti-fatigue bolt) is connected.

It has been proven in practice, however, that, during the operation, in particular, of large bore pistons, stresses can occur as a consequence of changing temperatures and pressures, with the result that a screw connection of this type (above all, configured centrally in the region of the piston stroke axis) is disadvantageous.

In order to counter said disadvantage, the idea has already been considered of arranging not only one screw connection, but rather a plurality of screw connections concentrically around the piston stroke axis. However, this means increased machining complexity both of the piston lower part and of the piston upper part. Moreover, a plurality of screws have to be stored and assembled, such that the assembly complexity is increased as a result. Moreover, there is the risk that one of the plurality of screws is forgotten during assembly. Furthermore, the cost expenditure is increased as a consequence not only of the machining, but rather also of the storage of a plurality of screws.

SUMMARY

The invention is therefore based on the object of providing a piston, by way of which the manufacturing costs and the component diversity can be reduced, and which functions flawlessly during the operation in the internal combustion engine.

According to the invention, an external threaded region including a threaded portion on the upper part and a threaded portion on the lower part is arranged between the lower part and the upper part of the piston, by way of which the external threaded region said two parts can be connected to one another by way of screwing. Said external threaded region is positioned concentrically around the piston stroke axis, with the result that said two parts are connected to one another by way of screwing, in order to realize an operationally ready piston, in particular a large bore piston. Here, the term "external threaded region" is to be understood to mean the threaded portion of the upper part and the threaded portion of the lower part which correspond to one another and are to be screwed to one another have threads which correspond to one another. Moreover, the term "external threaded region" is intended to clarify that this is not a thread or a screw connection in the region of the piston stroke axis, but rather that said external threaded region for the screw connection of the upper part and the lower part is configured and arranged concentrically around the piston stroke axis.

In one development of the invention, at least two supports are provided between the lower part and the upper part. This means not only that as known in the prior art, a contact face of the lower part corresponds with a contact face of the upper part, but rather that at least two contact faces which are separate from one another are provided in each case on the lower part and in each case on the upper part. As a result, the regions of the upper part and the lower part which are to be supported on one another during the operation of the piston can optimally be adapted to one another. Said at least two flat supporting regions can be designed in such a way that at least one of the supporting regions which face one another lies over the full surface area on one another (both in the static state of the piston and during operation), it also being possible for all the supporting faces to bear on one another in this case.

As an alternative to this, it is provided in one development of the invention that there is a gap at least in the static state, at least in the region of a support between the upper part and the lower part. This means that there is a main support and an auxiliary support, the main support allowing the upper part to be supported by way of the main support on the lower part in the static state of the piston (that is to say, before the installation into the internal combustion engine or at a standstill of the internal combustion engine), and there being an auxiliary support which realizes a gap between the upper part and the lower part in the static state (once again in the non-installed state of the piston or at a standstill of the internal combustion engine). The gap closes on account of the temperature loading and the ignition pressure loading only when the internal combustion engine is started up, with the result that previously existing tolerances are compensated for as a result. Moreover, it is possible as a result in a particularly advantageous way to counteract the deformation of the piston during the operation in the cylinder of the internal combustion engine, in order to effectively avoid damage of the piston as a consequence of stresses which would be the result without a gap of this type.

In one development of the invention, at least one nut is provided for maintaining the prestress between the lower part and the upper part of the piston during the operation of the internal combustion engine. In a further refinement, said nut can be assisted by way of a cup spring. A third support is produced in interaction with the nut and optionally the cup spring if the nut is tightened against the cup spring. It is to be noted here that the nut and optionally the cup spring do not have the object and effect of connecting the upper part to the lower part, since the external thread is used for this purpose. Rather, the nut and optionally the cup spring have the effect that the prestress, in particular with the configuration of the gap, for example, of the second support (auxiliary support), is obtained even during the operation of the internal combustion engine (engine run).

It is provided in one development of the invention that the external threaded region is formed by a circumferential land of the upper part and a corresponding circumferential land of the lower part. Those threaded portions of the upper part and the lower part which face one another can generally be made during the production of said two parts. As an alternative, they can be made subsequently after the production thereof. The configuration of the upper part with a circumferential land, that is to say a circumferential land which is open toward the bottom, is particularly advantageous, which land provides the upper part threaded portion as an internal thread, that is to say a thread which points in the direction of the piston stroke axis. Via said external threaded region, the upper part internal thread can be screwed onto the lower part threaded portion providing a corresponding external thread, that is to say a thread which points away from the piston stroke axis. Said two regions of the upper part (circumferential land) and the lower part (likewise circumferential land) can be reached very satisfactorily in the case of a separate production of said two parts, with the result that subsequent forming of the associated threads is possible.

After the two parts have been produced and are provided with the threaded portions (during the production) or have been provided subsequently with the threaded portions, the two parts can be screwed to one another, the screwing operation being ended when the upper part comes to rest by way of its associated at least one supporting face on the associated supporting face of the lower part. After this, the screw connecting operation can be ended. It is also conceivable to provide an anti-rotation safeguard. An anti-rotation safeguard can be, for example, a screw, a pin, a rivet or the like which prevents the two parts of the piston from moving relative to one another. As an alternative or in addition to this, it can also be envisaged to connect the two parts to one another permanently after ending of the screw connecting operation in an integrally joined manner, for example by way of welding, soldering, adhesive bonding or the like.

BRIEF DESCRIPTION OF THE DRAWINGS

Different embodiments of a piston according to the invention will be described in the following text and will be explained using the figures, in which.

DETAILED DESCRIPTION

Figure 1:
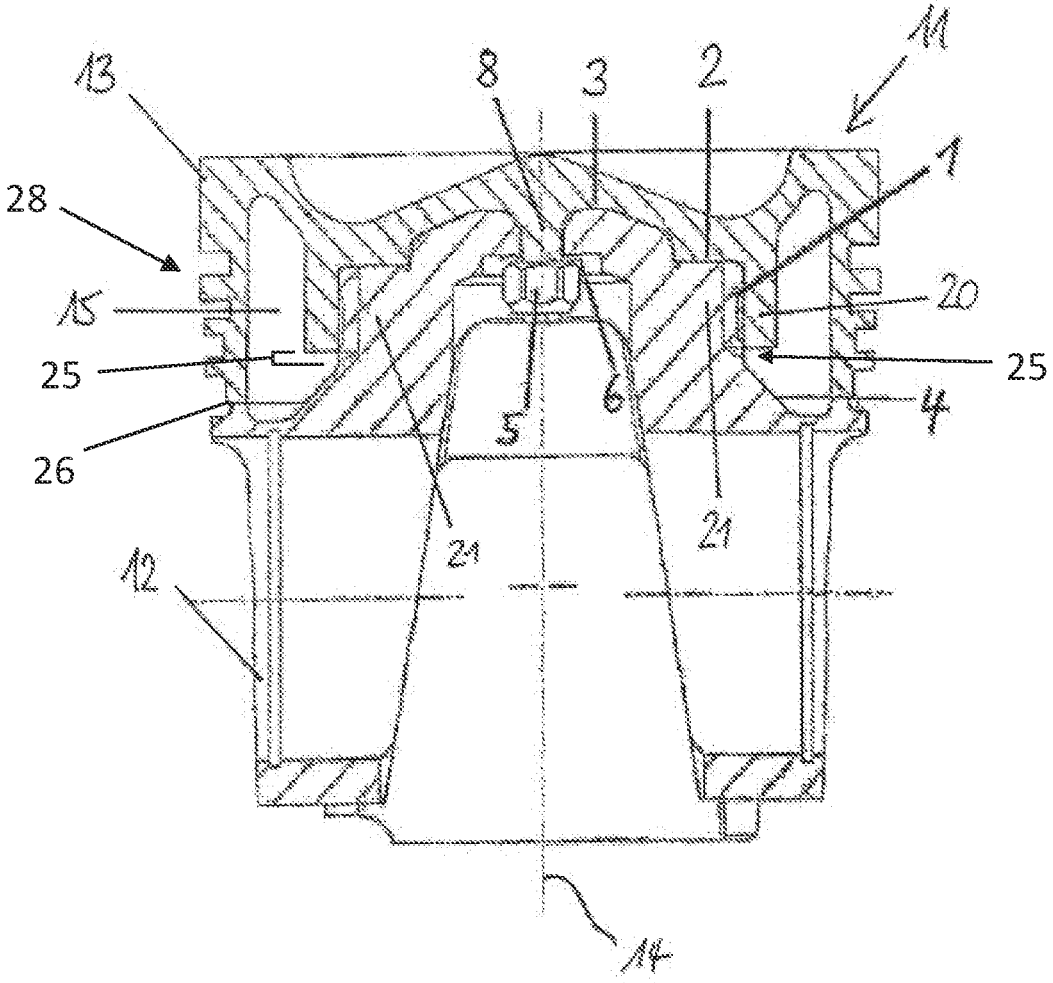
FIG. 1 shows a sectional view of a piston along its pin axis.
Figure 2:
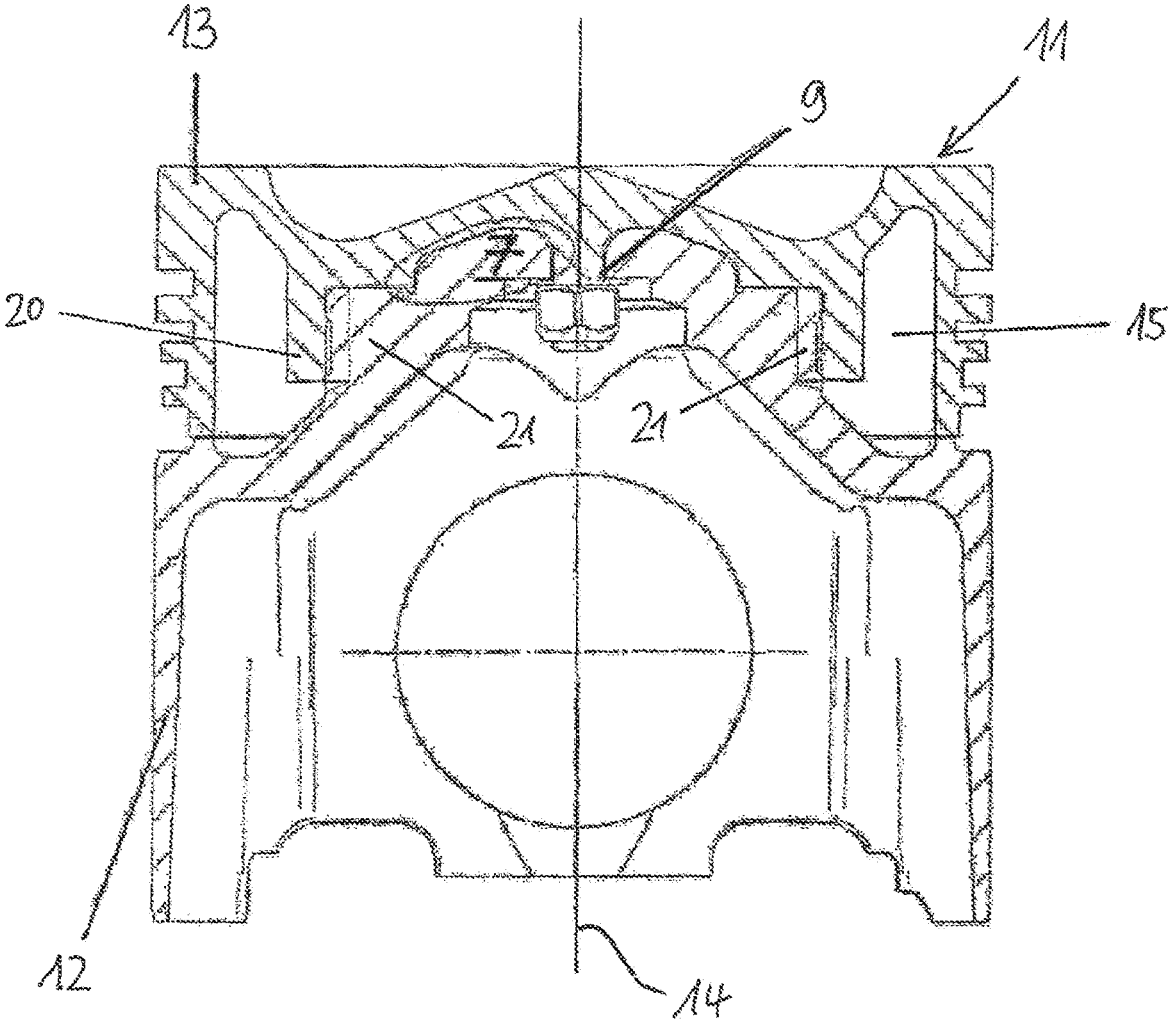
FIG. 2 shows a sectional view of the piston in accordance with FIG. 1 transversely with respect to its pin axis.

FIGS. 1 and 2 show a piston 11 in two different views, the piston 11 being formed by way of a lower part 12 and an upper part 13. Said two parts 12, 13 are produced in a suitable way (for example, by way of forging, casting or the like). The materials can be identical or different. The lower part 12 has elements which are known per se such as load-bearing skirt wall sections, pin bosses, pin bores and the like. The upper part 13 which comprises a piston stroke axis 14 in the same way as the lower part 12 has elements which are known per se such as a ring zone 28 having a lowest distal end 26, optionally a combustion chamber recess and optionally a cooling gallery 15. The cooling gallery 15 is present in the case of the exemplary embodiment, but can also be dispensed with.

On account of the geometries of the lower part 12 and the upper part 13, they are connected to one another concentrically around the piston stroke axis 14 by means of an external threaded region 1. Moreover, a main support 2, an auxiliary support 4 and optionally a third support 3 are provided. The upper part 13 and the lower part 12 are screwed to one another via the external threaded region 1. The main loading during the connection of said two parts is therefore supported by way of said external threaded region 1. Said thread therefore serves to actually hold (connect) the upper part 13 with respect to the lower part 12. After the assembly, at least the main support 2 which is required in every case is produced. In addition, an auxiliary support 4 is produced which, in the static state, either allows the associated faces of the two parts 12, 13 to bear against one another after ending of the screwing operation, or forms a gap 25 (see FIGS. 1 and 3 for example). The configuration of a gap 25 in the region of said auxiliary support is particularly advantageous if the two parts 12, 13 are screwed to one another in a completed manner Via said gaps, deformations of the piston during the operation of the internal combustion engine can firstly be compensated for, said gap secondly being present only in the static state. The gap 25 decreases as a consequence of temperature increases and/or deformations of the piston during the operation of the piston in the internal combustion engine, with the result that the associated regions of the lower part 12 and the upper part 13, just like the regions of the main support 2, come into contact in the region of the auxiliary support 4, with the result that stability of the piston during the operation of the internal combustion engine is achieved effectively in this way, but at the same time stresses and therefore damage, such as cracks, are also avoided. In the example shown in FIGS. 1 and 2, the piston 11 includes a ring zone 28 formed by a portion of the upper part 13 and a portion of the lower part 12. The upper part 13 portion of the ring zone 28 includes a lowest distal end 26. As best seen in the FIG. 1 example, the gap 25 is positioned radially inward toward the piston stroke axis 14, and positioned axially above (i.e., relative to the piston stroke axis) the upper part ring zone lowest distal end 26.

In the case of the piston 11 of the exemplary embodiment in FIGS. 1 and 2, a nut 5 is also arranged in the region of the piston stroke axis 14, which nut 5 can interact with a cup spring 6, but does not have to. The third support 3 is formed as a result if the nut 5 is tightened against the cup spring 6. The nut 5 and the cup spring 6 do not have the object, however, of connecting the upper part 13 to the lower part 12, but rather of obtaining the prestress even during the operation of the piston 11 in the internal combustion engine. To this end, it is proposed to increase the effect of the nut 5 by way of the effect of the cup spring 6, it also possibly being possible for the cup spring 6 to be dispensed with. Furthermore, the lower part 12 is configured in a region 7 (marked in FIG. 2) in such a way that, during tightening of the nut 5, the region 7 is pulled (pressed) against the upper part 13. This results in a further prestress between the upper part 13 and the lower part 12. The cup spring 6 can be dispensed with if it proves that the prestress can be applied solely by the region 7. As shown, the thread of the nut 5 is attached on a forged extension 8 of the upper part 13. This serves only for explanation, since the extension 8 of the upper part 13 can also be replaced by a screw.

In the case of the exemplary embodiment in accordance with FIGS. 1 and 2, the upper part 13 forms a circumferential land 20 having an internal thread and, in a manner which corresponds to this, the lower part 12 forms a circumferential land 21 having an external thread for corresponding threaded engagement with the upper part circumferential land 20 internal thread. As shown, the circumferential land 20 is of approximately rectangular and relatively thin cross section, whereas the circumferential land 21 of the lower part 12 is configured in a solid manner by way of the lower part 12. It goes without saying that other forms of the upper part 13 and the lower part 12 for forming the external threaded region 1 are conceivable.

Figure 3:
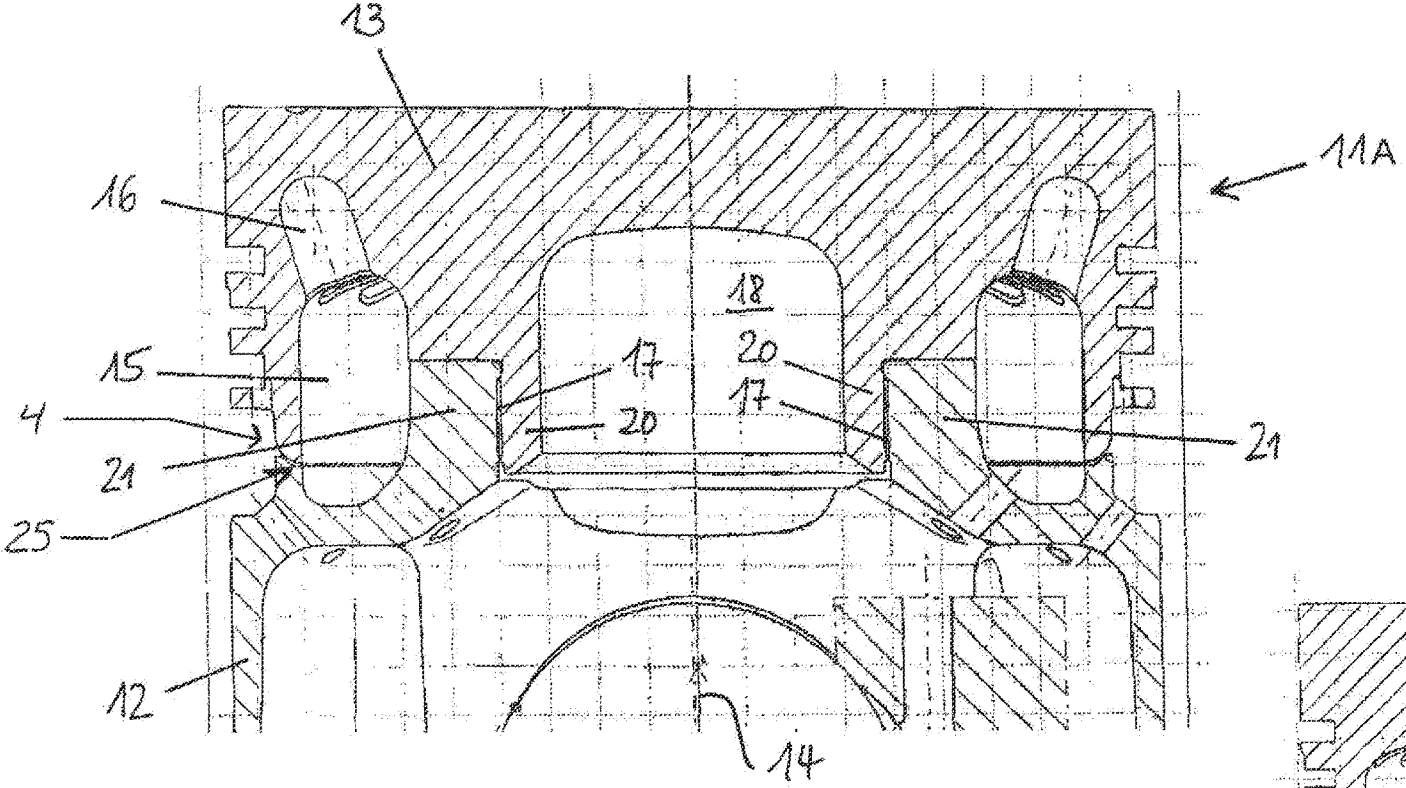
FIG. 3 shows a further exemplary embodiment of a piston transversely with respect to its pin axis.

FIG. 3 shows a further exemplary embodiment of the piston 11A. It can be seen that the annular circumferential cooling gallery 15 can have upwardly directed extension bores 16. In order to increase the cooling effect, a plurality of extension bores which are distributed over the circumference are made in the upper part 13, starting from the cooling gallery 15. In the case of said exemplary embodiment, 17 likewise denotes an external thread (in an analogous manner with respect to the external thread 1 in the case of the preceding exemplary embodiment), there also being the at least one main support 2 and the auxiliary support 4 (optionally the third support 3) here in the case of said piston 11A in accordance with FIG. 3. There are also once again the lands 20, 21 which correspond to one another.

Figure 4:
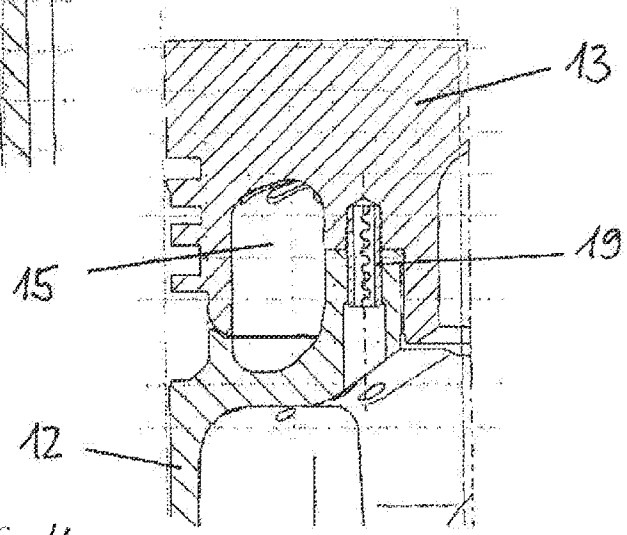
FIG. 4 shows a further exemplary embodiment of a piston.

In a difference from the exemplary embodiment in accordance with FIGS. 1 and 2, the piston 11A in accordance with FIG. 3 has an inner region 18 without a nut 5, without a cup spring 6 and without an extension 8. Moreover, said piston 11A does not have a combustion chamber recess, it optionally being possible for said combustion chamber recess to be present, however. The inner region 18 is shaped out above the pin bore and can likewise be used for cooling purposes FIG. 4 shows details of the piston 11B, approximately in accordance with the piston 11A in accordance with FIG. 3, an anti-rotation safeguard 19 also being provided between the lower part 12 and the upper part 13. Said anti-rotation safeguard 19 can be a pin, a screw, a spring-loaded pin for engaging into a recess of the opposite part or the like. This is a positively locking anti-rotation safeguard 19. As an alternative or in addition to this, the two parts 12, 13 can also be prevented from rotating with respect to one another during the operation in the internal combustion engine in an integrally joined manner, such as soldering, welding, adhesive bonding or the like.

The following is also to be noted with regard to the manufacture. The upper part 13 and the lower part 12 can be manufactured on a counter spindle machine. After the machining of the external threaded region 1, 17 (that is to say, of the corresponding threaded portions on the lower part 12 and the upper part 13) and optionally of the inner contour (for example, of the inner region 18), the two parts 12, 13 are screwed together. The precision machining (that is to say, the running clearance) therefore takes place in the assembled state, with the result that no concentricity is produced between the upper part 13 and the lower part 12. In addition, a fitting slot 9 (shown in FIG. 2) can also be made on the forged extension 8 and the lower part 12, with the result that the relative movement between the upper part and the lower part is as low as possible or even does not exist at all anymore during the operation of the piston 11, 11A or 11B in the internal combustion engine. To this end, the anti-rotation safeguard 19 can be used, but does not have to be used.

In general, it is to be noted once again that there can be a gap between the lower part and the upper part in the static state, at least in the region of a support. A simple and effective piston connection is provided, without welding. A simple and secure connection of the lower part and the upper part takes place without welding or clamping. The lower part and the upper part are therefore joined releasably by way of a non-positive or positively locking connection to form a piston. If the screw connection between the lower part and the upper part is of prestressed configuration (for example FIGS. 1 and 2) or relies only on the external threaded region 1 or 17 for connection (for example FIG. 3), this is a non-positive connection. If the screw connection between the lower part and the upper part is not of prestressed configuration and utilizes an anti-rotation safeguard (for example 19 in FIG. 4), this is a positively locking connection. Mixed forms between a non-positive connection and a positively locking connection can likewise exist in the case of the connection of the lower part and the upper part to form a piston.

LIST OF DESIGNATIONS

1 External thread
2 Main support
3 Third support
4 Auxiliary support
5 Nut
6 Cup spring
7 Region
8 Extension
9 Fitting slot
11 Piston
12 Lower part
13 Upper part
14 Piston stroke axis
15 Cooling gallery
16 Extension bore
17 External thread
18 Inner region
19 Anti-rotation safeguard
20 Circumferential land
21 Circumferential land
25. Gap
26. Upper part ring zone lowest distal end
28. Ring zone

The invention claimed is:

1. A piston of an internal combustion engine, formed from a lower part and an upper part having a piston crown, the lower part and the upper part being joined to form the piston by way of a non-positive connection, comprising:

a main support defined by a lower part first contact surface and an upper part first contact surface opposing the lower part first contact surface, the main support positioned radially outwardly distant from a piston stroke axis;

an auxiliary support defined by a lower part second contact surface and an upper part second contact surface opposing the lower part second contact surface, the auxiliary support positioned radially outward of the main support;

a lower part threaded portion positioned radially outward of and directly adjacent to the main support; and an upper part threaded portion positioned radially outward of and opposing the lower part threaded portion, the lower part and upper part threaded portions operable to threadingly engage and position the lower part first contact surface and the upper part first contact surface in abutting engagement, wherein on threaded engagement of the lower part and the upper part threaded portions and abutting engagement of the lower part first contact surface and the upper part first contact surface, the auxiliary support defines an axial gap parallel to the piston stroke axis axially between the lower part second contact surface and the upper part second contact surface in a static state, the gap is positioned radially inward from and axially above an upper part ring zone lowest distal end of a ring zone, wherein in operation in the internal combustion engine the piston is operable to allow axial expansion of a portion of at least one of the upper part or the lower part into the axial gap.

2. The piston of claim 1 wherein the upper part further comprises a threaded extension positioned along the piston stroke axis and extending axially toward the lower part; and a nut threadingly engaging the threaded extension, the nut operable for maintaining a prestress between the lower part and the upper part of the piston during operation of the internal combustion engine.

3. The piston of claim 2 further comprising a cup spring positioned circumferentially about the threaded extension and axially between the lower part and the nut, the nut and the cup spring operable for maintaining the prestress between the lower part and the upper part of the piston during the operation of the internal combustion engine.

4. The piston of claim 1, wherein the upper part threaded portion comprises a circumferential land and the lower part threaded portion comprises a circumferential land positioned opposing the upper part threaded portion circumferential land.

5. The piston of claim 1 wherein the lower part further comprises a third contact surface positioned radially between the piston stroke axis and the main support; and the upper part further comprises a third contact surface opposing the lower part third contact surface, the lower part third contact surface and the upper part third contact surface defining a third support.

6. The piston of claim 1 wherein the auxiliary support is positioned radially outward of the main support and radially inward of the upper part land piston ring belt.

7. The piston of claim 1 wherein the axial expansion of at least one of the upper part or the lower part into the axial gap closes the axial gap.

8. The piston of claim 1 wherein the axial expansion of at least one of the upper part or the lower part into the axial gap closes the axial gap.

9. A piston for use in an internal combustion engine comprising:

a lower part having a circumferential land defining an internal threaded portion positioned circumferentially about a piston stroke axis facing in a direction radially inward toward the piston stroke axis, the lower part having a first contact surface and a second contact surface positioned radially distant from the first contact surface;

an upper part having a circumferential land defining an external threaded portion positioned circumferentially about the piston stroke axis facing in a direction radially outward from the piston stroke axis, the upper part circumferential land positioned radially inward from the lower part circumferential land, the upper part having a first contact surface and a second contact surface positioned radially distant from the first contact surface, the upper part external threaded portion selectively threadingly engaging the lower part internal threaded portion to connect the upper part to the lower part;

a main support defined by the abutting engagement of the lower part first contact surface and the upper part first contact surface on the threaded engagement of the upper and the lower part, the lower part internal threaded portion positioned radially inward of and directly adjacent to the main support; and an auxiliary support defined by the lower part second contact surface and the upper part second contact surface on threaded engagement of the upper part and the lower part, wherein on threaded engagement of the lower part internal threaded portion and the upper part external threaded portion and abutting engagement of the lower part first contact surface and the upper part first contact surface, the auxiliary support defines an axial gap parallel to the piston stroke axis axially between the lower part second contact surface and the upper part second contact surface in a static state, wherein in operation in the internal combustion engine the piston is operable to allow axial expansion of a portion of at least one of the upper part or the lower part into the axial gap.

10. The piston of claim 9 wherein the upper part and the lower part define an axial anti-rotation bore extending through the main support, the piston further comprising an anti-rotation device positioned within the anti-rotation bore, the anti-rotation device operable to prevent rotation of the upper part relative to the lower part about the piston stroke axis.

11. The piston of claim 9 wherein the upper part and the lower part define an inner region cavity positioned vertically above a pin bore along the piston stroke axis.

12. The piston of claim 9 further comprising:

a cooling gallery defined by the upper part and the lower part extending circumferentially about the piston stroke axis, the cooling gallery further defining a plurality of extension bores extending upwardly and in fluid communication with the cooling gallery.

13. A piston for use in an internal combustion engine comprising:

a lower part having an internal threaded portion positioned circumferentially about a piston stroke axis, the lower part having a first contact surface and a second contact surface positioned radially distant from the first contact surface;

an upper part having an external threaded portion positioned radially distant from and circumferentially about the piston stroke axis and a first contact surface and a second contact surface positioned radially distant from the first contact surface, the upper part threaded portion selectively threadingly engaging the lower part threaded portion to connect the upper part to the lower part;

a main support defined by the abutting engagement of the lower part first contact surface and the upper part first contact surface on the threading engagement of the upper and the lower part, the upper part and the lower part further defining an axial anti-rotation bore extending through the main support;

an auxiliary support defined by the lower part second contact surface and the upper part second contact surface on threaded engagement of the upper part and the lower part; and an anti-rotation device positioned within the anti-rotation bore, the anti-rotation device operable to prevent rotation of the upper part relative to the lower part about the piston stroke axis, wherein on threading engagement of the lower part internal threaded portion and the upper part external threaded portion and abutting engagement of the lower part first contact surface and the upper part first contact surface, the auxiliary support defines an axial gap parallel to the piston stroke axis axially between the lower part second contact surface and the upper part second contact surface in a static state, wherein in operation in the internal combustion engine the piston is operable to allow axial expansion of at least one of the upper part or the lower part into the axial gap to accommodate at least one of temperature loading or ignition pressure loading, the axial expansion of at least one of the upper part of the lower part into the axial gap closes the axial gap.

* * * * *